United States Patent [19]

Cox

[11] Patent Number: 4,601,348

[45] Date of Patent: Jul. 22, 1986

[54] REVERSIBLE AUGER DRIVE KIT FOR POST HOLE DIGGER

[76] Inventor: Floyd E. Cox, 2200 G. Bushnell Dr., Columbia, Mo. 65201

[21] Appl. No.: 644,065

[22] Filed: Aug. 24, 1984

[51] Int. Cl.[4] ..... E21B 7/02

[52] U.S. Cl. ..... 173/25; 173/26; 74/377

[58] Field of Search ..... 173/40, 41, 19, 145, 173/146, 151, 25, 148, 159, 160, 170, 165, 166, 26; 74/377

[56] References Cited

U.S. PATENT DOCUMENTS

| | | | |
|---|---|---|---|
| 1,726,565 | 9/1929 | Hunt | 173/151 |
| 1,831,437 | 11/1931 | Brantly | 173/151 |
| 2,230,757 | 2/1941 | Long | 255/19 |
| 2,416,056 | 2/1947 | Zimmerlian et al. | 173/19 |
| 2,614,806 | 10/1952 | Connors | 255/22 |
| 2,639,892 | 5/1953 | Jones | 173/19 |
| 2,890,860 | 6/1959 | Smith | 173/160 |
| 3,132,705 | 5/1964 | McGee | 173/160 |
| 3,221,823 | 12/1965 | Tonti et al. | 173/25 |
| 3,976,147 | 8/1976 | Cunningham | 173/22 |

*Primary Examiner*—Donald R. Schran
*Assistant Examiner*—James L. Wolfe
*Attorney, Agent, or Firm*—Gravely, Lieder & Woodruff

[57] ABSTRACT

A reversible drive kit applied between a power input torque shaft and the driving head of an auger having a pinion that can be exposed and used to connect up with a suitable receiver in the kit. The arrangement of components in the kit frame includes a pair of ring gears carried by the receiver, a train of gears and a shift lever connected to one of the pair of ring gears and connecting it to the train of gears for change of direction of auger rotation, and a directional control lever.

6 Claims, 9 Drawing Figures

REVERSIBLE AUGER DRIVE KIT FOR POST HOLE DIGGER

BACKGROUND OF THE INVENTION

1. Field of the Invention

This invention pertains to improvements in auger drives for post hole diggers, and especially a drive kit having the capability to be reversed in the process of digging a hole.

2. Description of the Prior Art

The use of screw-type augers for digging holes is well recognized in the field, and is exemplified by such efforts as Long U.S. Pat. No. 2,230,757 of Feb. 4, 1941 which has disclosed a reversible auger connected to a case having a bevel gear. The bevel gear is driven by a two-part drive shaft with a reversing transmission connected between the two drive shafts. The transmission is inserted to obtain rotation to facilitate its withdrawal. A similar arrangement is disclosed in Connors U.S. Pat. No. 2,614,806 of Oct. 21, 1952.

In this art there are examples of the use of bevel gears for obtaining digging operation and withdrawal of a digger-type auger by reversing the position of the bevel driving gear. These are exemplified in Tonti et al U.S. Pat. No. 3,221,823 of Dec. 7, 1965 and Cunningham U.S. Pat. No. 3,976,147 of Aug. 24, 1976.

The problems present in the prior digger devices are related to the size and weight of reversible drive means, the cost of reversible drives, and the complex mechanism used to connect the reversible drive assembly to the digger. In these devices the drive is specially designed and requires a wholly individual assembly that is not suitable for use on existing equipment.

BRIEF DESCRIPTION OF THE EMBODIMENT

The present invention exhibits a unique adapter device for use with tractors and similar vehicles having post hole digger attachments which drive an auger in the digging direction but do not provide means to reverse the auger rotation, should an obstruction of most any type be encountered to stop the auger or stall the power input. In these limited vehicles the withdrawal of the auger is to lift it bodily.

The preferred embodiment takes the form of a kit or adapter package in which a simple gear transmission with forward and reversing capability is arranged. The kit or adapter package is remotely controllable by an operator seated on the vehicle furnishing the support and drive for a post hole digger.

The objects of the present invention are to provide a kit that supplies an external reversing capability for vehicle power take-off drives, to provide a gear train having the ability to deliver the necessary torque for effective auger digging action, and to stabilize the kit against torque loads that may be developed by the auger encountering obstructions.

It is a further object of the present invention to provide a gear transmission with unique wear reducing features while retaining an ability to handle a wide range of torque loads encountered during auger drive in either direction.

Other objects will become evident as the detailed description proceeds.

BRIEF DESCRIPTION OF THE DRAWINGS

The present invention is illustrated in a presently preferred structural arrangement shown in the drawings which include.

DETAILED DESCRIPTION OF THE INVENTION

Figure 1:
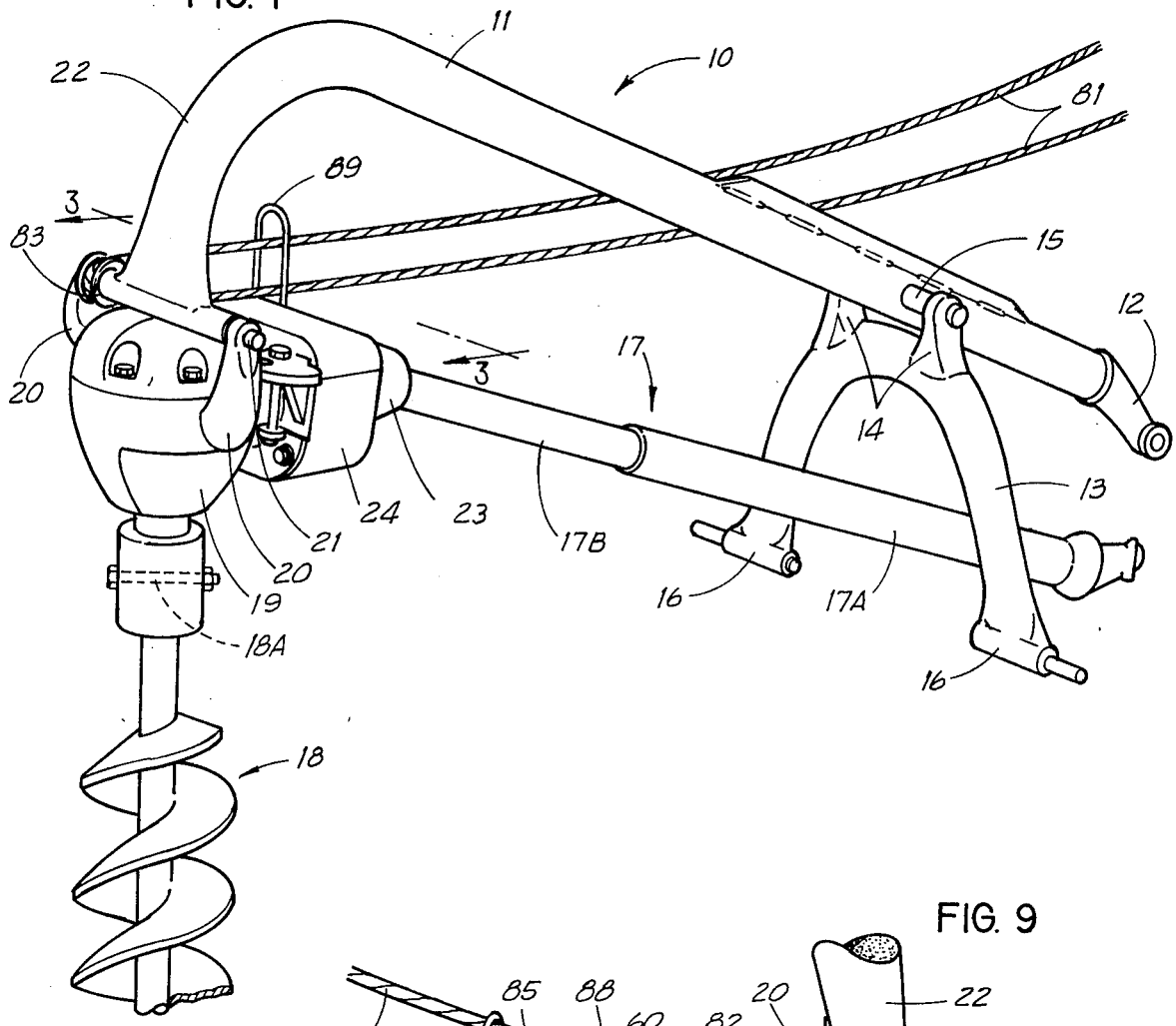
FIG. 1 shows in perspective the general arrangement of an auger supporting boom and power drive which may be suitable for use with vehicles having a power take off-head and a three-point mounting for the boom.
Figure 9:
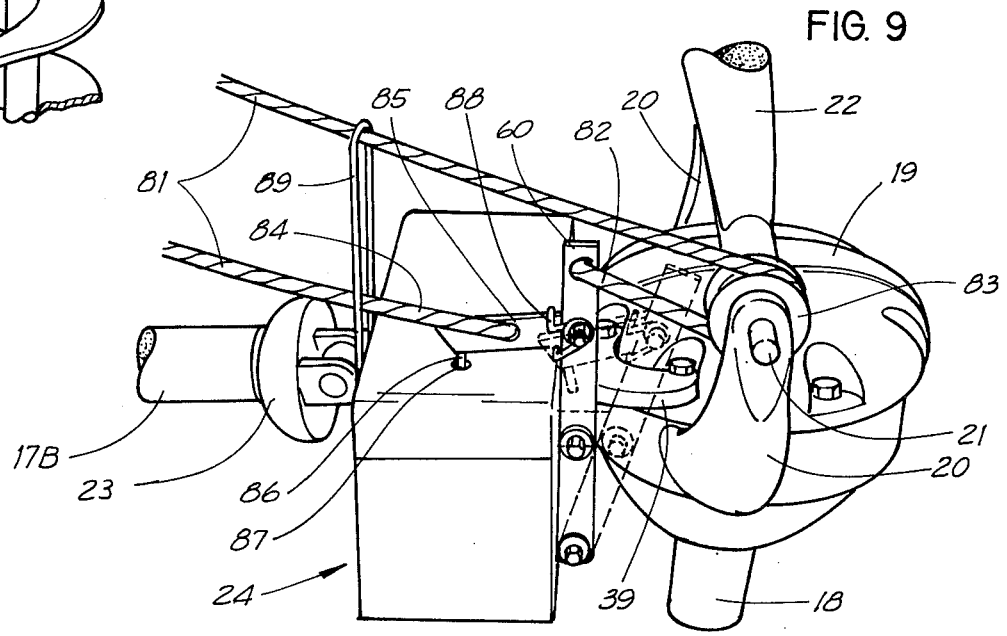
FIG. 9 is a fragmentary perspective view of the control means for selecting forward or reverse drive for the auger.

The presently preferred embodiment of the invention resides in a reversible drive adapter to be inserted in a post hole digger assembly which is an add-on attachment in most cases for a tractor having a three-point hitch and a power take-off. The drive may operate from the tractor hydraulic system. A tractor hitch for an auger drive is a well known provision of tractors and no drawing disclosure is believed necessary. Thus, FIG. 1 is a perspective showing of a hole digging attachment assembly 10 which includes a boom 11 having a pivot 12 for attachment to a pivot bracket (not shown) on the tractor. The boom 10 is supported by a yoke 13 having a pair of lugs 14 to support a pin 15 carried by the boom 11. The yoke 13 has its spaced leg ends 16 formed to mate with attachment on the tractor to complete a three-point hitch.

The power take-off system of the tractor has an output attachment to which the torque shaft 17 is connected at its inner end fitting 17A. The shaft 17 is of telescoping character in which the larger torque tube 17A receives the small torque tube 17B in a spline driving connection so the tube 17B is able to slide in the tube 17A to compensate for changes in the swing of the boom 11 in an arc during operation of the auger 18 which follows a vertical or nearly vertical line of travel.

As seen in FIG. 1 the auger 18 is driven by a gear assembly (not shown) in drive head 19, and that housing is connected by brackets 20 that support pivot shaft 21 to the outer end 22 of the boom 11. Prior to installation of the kit 24 of this invention, the torque tube 17B is normally connected directly to the gear assembly in drive head 19 through a suitable universal joint, part of which is seen at 23. Thus far, the description relates to known features which are shown to provide background for that which follows.

Figure 3:
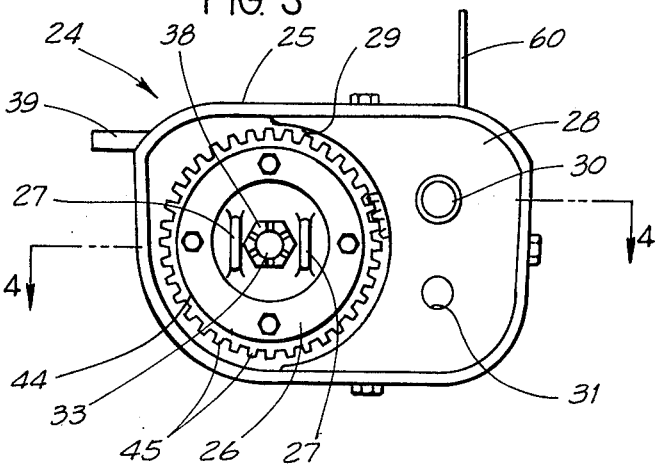
FIG. 3 is a front elevation view of the adapter kit as seen along line 3—3 in FIG. 1.

Turning now to FIG. 3, which is a view as seen by the tractor operator, the kit 24 has a frame 25 to receive an adapter plate 26 having a yoke 27 of a universal joint. The other yoke part of this joint is noted at 23 in FIG. 1. Next to the plate 26 is a support plate 28 having a circular cutout margin 29 so there is space to receive the plate 26 and components associated with that plate. The plate 28 is, itself, formed with a projecting bearing boss 30, and an inwardly directed boss 31, both of which will be referred to presently.

Figure 2:
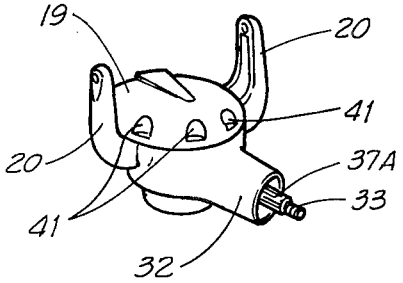
FIG. 2 is a fragmentary view in perspective of the auger drive gear housing as seen from the side opposite to the view of FIG. 1.

The frame with its internal gears and functioning components (FIG. 4) slips over the projecting casing extension 32 (FIG. 2) of the auger drive head 19, and the exposed end of the pinion shaft 33 projects out of that extension 32. As the frame has its rear wall 34 formed with an opening 35 the extension 32 on drive head 19 enters the opening and seats in the cup-shaped receiver 36 with the extension 32 received over the internally splined projection 37 of that receiver. The end 33 of the pinion extends beyond the spline projection 37 so a castillated nut 38 can be threaded up to secure the parts in assembly. The pinion is formed with an external spline (not shown) to mate with the internal spline of projection 37 to establish a drive connection with the receiver 36. In effecting this assembly, the frame 25 must be securely attached to the gear housing 19 by aligning the mounting tabs 39 and 40 in recesses 41 (FIG. 2) of driving head 19 so they can be secured by suitable cap screws. When properly installed the cup-shaped receiver 36 is connected by its spline projection 37 to the mating spline 37A on the pinion 33.

Figure 4:
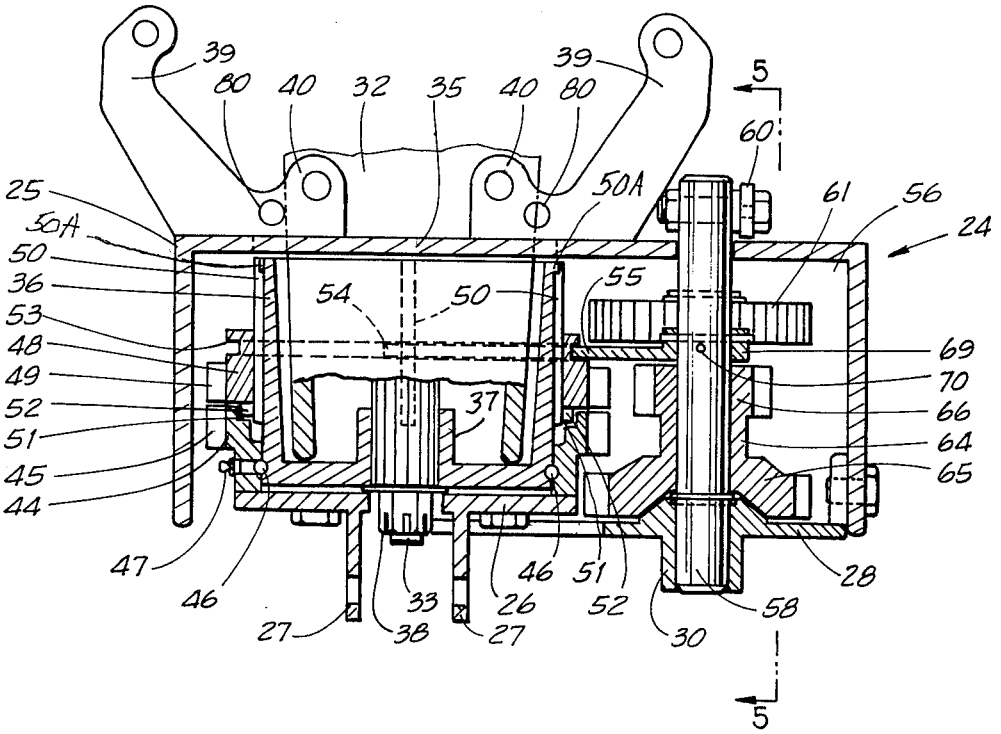
FIG. 4 is a longitudinal section view showing the gear transmission in normal auger digging position.
Figure 5:
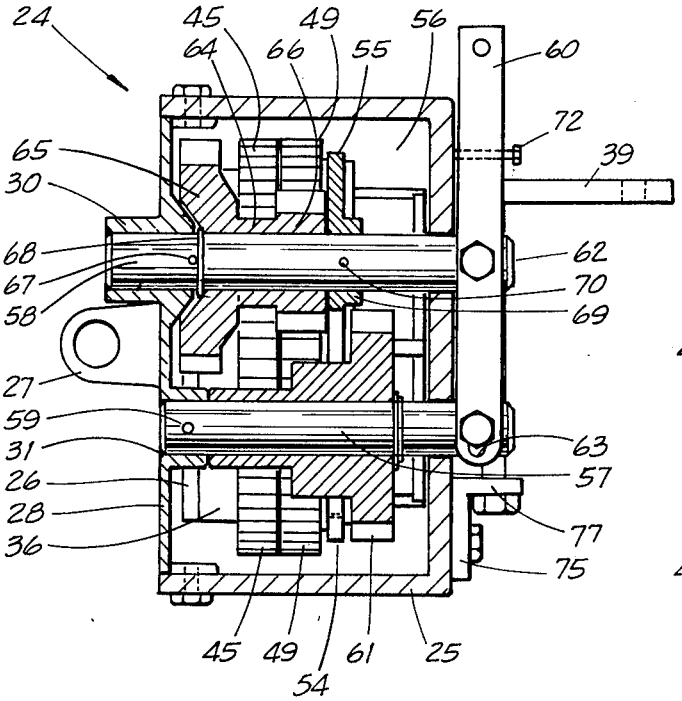
FIG. 5 is a transverse section view taken along line 5—5 in FIG. 4.

FIGS. 4 and 5 illustrate the components of the kit 24 in more detail. The adapter plate 26 is formed with the yoke elements 27 which connect to universal joint 23, and this plate is bolted onto the end rim of a ring gear 44 which surrounds the closed end of receiver 36 so that the teeth 45 rotate in the space outside the receiver 36. The ring gear 44 is operatively rotatable on the receiver 36 by reason of bearing balls 46 being retained in matching races 46A in those parts. The balls 46 are fed into the matching races and after the last ball is inserted, a lube fitting 47 acts as a plug. A second ring gear 48 with teeth 49 is operatively mounted on the receiver 36, and is movable toward and away from the ring gear 44 on a plurality of splines 50 spaced around the outer surface of the receiver 36. The respective splines 50 are canted at an angle of about two degrees to the longitudinal axis of the extension 32. It is to be noted that gear 44 is formed with recesses 51 at suitable spacing around its rim and in position to receive matching projections 52 formed on the facing rim of gear 48. Also gear 48 is formed with a circumferential slot 53 which receives the arms 54 of a shift level 55. In the position of the shift lever 55 seen in FIG. 4, the gears 44 and 48 are interengaged with each other by meshing of the projections 52 on gear 48 with recesses 51 on gear 44. Thus, these gears rotate together, and because of gear 48 being positively connected by splines 50 to the receiver 36, drive input at the universal elements 27 will be transferred from gear 44 to gear 48 and then to the receiver 36 and its positive spline connection 37 with the spindle 33. The result is that power from the torque shaft 17 is transmitted directly into the receiver 36 and to spindle 33 for driving the gears in the drive head 19 of FIG. 1. This cooperation of components results in rotation of the auger 18 in a hole digging or forward direction.

Turning now to FIG. 5, it is seen that the frame 25 provides a space 56 for a system of auger reversing gears. For this purpose, the frame 25 and the support plate 28 carry shafts 57 and 58. Shaft 57 is fixed with its end in the internal boss 31 held by a pin 59. The opposite end of shaft 57 projects from frame 25 and is used as the pivot support for a control lever 60. Shaft 57 carries an idler gear 61 which is free to rotate on the shaft in the position seen in FIG. 5. The upper shaft 58 is slidably mounted in the bearing boss 30 and the wall of frame 25, with one end 62 projecting out so it can be connected to the control lever 60. The lower end of control lever 60 has a slot 63 to allow for moving the upper shaft 58, as is well understood. Upper shaft 58 carries a gear train in the form of a cluster gear body 64 which includes a large diameter or great gear 65 and a small diameter or lesser gear 66. The cluster gear body 64 is free to rotate on the shaft 58, while being fixed against sliding on shaft 58 by a pin 67 and a snap ring 68 adjacent the large diameter gear 65. The small diameter gear end of the cluster gear body 64 is in abutment with the hub 69 of shift lever 55, and the hub is fixed to the shaft 58 by a pin 70. Thus, when the shaft 58 is slid rightwardly (in FIG. 5) the shift lever 55 moves the gear cluster body 64 with it, and also moves the ring gear 48 on its splines 50 to disengage the ring gear 44.

Figure 6:
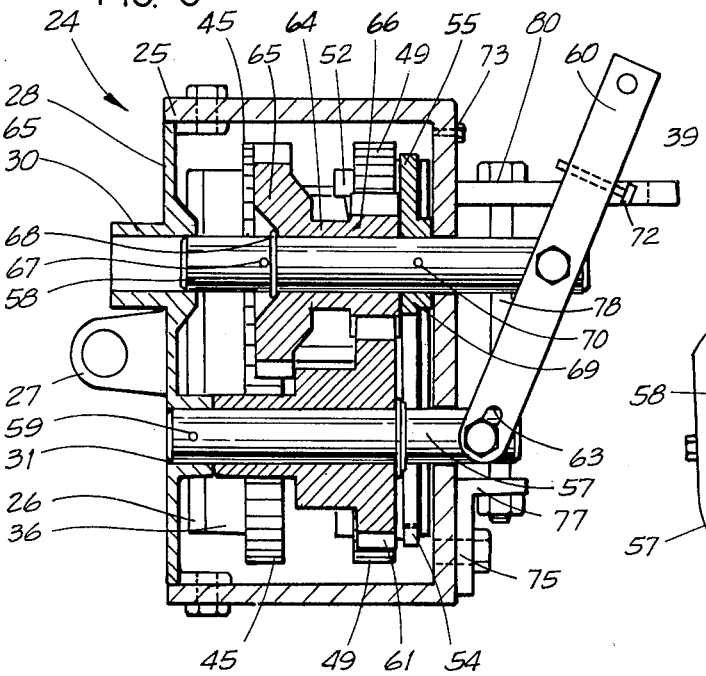
FIG. 6 is a longitudinal section view similar to FIG. 5 showing the gear transmission in an auger reversing setting.

The operation of the gears in the kit 24 for reversing the direction of rotation of the auger 18 is as follows: The control lever 60 is moved to the position in FIG. 6 where shaft 58 is slid to the right to cause the shift lever 55 to slide ring gear 48 out of engagement with the ring gear 44 and bring it into mesh with the idler gear 61 on the lower fixed shaft 57. In addition, the movement of the shaft 58 slides the gear cluster body 64 to a position where the large or great gear 65 meshes with the ring gear 44, and that moves the small or lesser gear 66 into mesh with the idler gear 61. In this manner, the power input at the adapter 26 is transferred by ring gear 44 into the larger gear 65 of the cluster gear body 64, and the smaller gear 66 of the cluster gear body 64 moves into mesh with the idler gear 61 on the shaft 57 for driving the idler gear 61 which is, in turn, meshed with the ring gear 48 to rotate the receiver 36 in the opposite direction from that which obtains with the gears in the position of FIG. 5. When this shifting of the gears takes place, the torque from shaft 17 is applied to reverse the direction of the receiver and the spline connected pinion 33, and that, in turn, will result in reversing the rotation of the auger 18. The ability to reverse the auger 18 is necessary when it has spiralled under an obstruction and has stopped the power source or sheared off the pin 18A at the auger drive head, or the tractor three-point lift is not able to lift the auger out of the ground.

It has been pointed out that the shift lever 55 has fingers that engage in the circumferential groove or slot 53 in ring gear 48. Since the gear 48 constantly rotates in both drive and reverse conditions in the kit 24, there is provided a finger centering adjustment in a tappet 72 threaded in the lever 60 to cooperate with an abutment 73 on the frame 25. The tappet can be adjusted in or out relative to the shift lever so the shift lever fingers 54 are substantially centered in the slot or groove 53 in gear 48.

Figure 7:
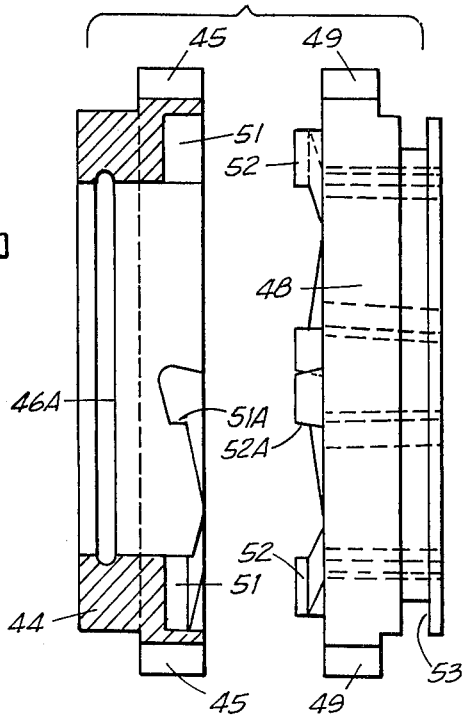
FIG. 7 is an exploded view of gears which have cooperating ramp surfaces for effecting a driving engagement between these gears.

In view of the reversing function of the gears in kit 24, without stopping the power into torque shaft 17, the meshing of the gears becomes important so the torque will not damage the components that are related to accomplish the reversal. This is accomplished (FIG. 7) by the provision of half-step ramps 51A, 52A to prevent torque from advancing the ring gear 48 ahead of its proper mesh with ring gear 44. The half step ramps 51A, 52A are provided to prevent the advance torque forcing the ring gears 44 and 48 apart which will bend the hook 86 on the lever latch 85. This advance can happen when the auger 18 strikes an obstruction and shears the pin 18A at the auger. The drive ramp system includes four ramps 51, 52, each of which has a seven (7°) degree angle to interlock as the power drive pressure is applied on both the ring gears 44 and 48. The angled splines 50 on the receiver 36 have the angle of two (2°) degrees so the ring gear 48 will have a sliding pressure in the direction to maintain gear mesh against the one-half degree of draft that is built into the cast gear teeth in the reverse idler gear 61. The spline angle of two (2°) degrees also acts to hold the ring gear 48 against the spline stops 50A on all of the splines when in reverse drive, as well as assisting in connecting the four drive ramps 51 and 52 on ring gears 44 and 48 in forward digging. This arrangement eliminates the need for a detent to center the shift lever 55 by adjusting the stop screw 72 on the shift control lever 60 which prevents wear on the fingers 54 of the shift lever 55.

During the reverse shifting of the kit 24, the larger or great gear 65 of the gear train cluster gear 64 must engage the ring gear 44 before the shiftable ring gear 48 makes meshing contact with the reversing idler gear 61 which is driven by the smaller or lesser gear 66 of the cluster gear 64. The teeth of gear 66 slide across the idler gear teeth, but must stay engaged to turn in synchronism with the teeth on the shiftable ring gear 48 when it is shifted from forward drive to neutral and then into reverse. The neutral gear position is reached when the shift lever 55 has disengaged the ring gears 44 and 48 and before the great gear 65 has engaged ring gear 44, as seen in FIG. 4 by the spacing of the teeth in gears 44 and 65.

Figure 8:
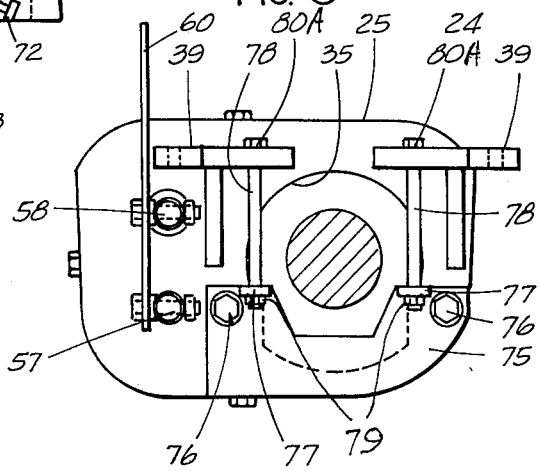
FIG. 8 is a view of the back of the adapter showing the stabilizer plate and the tension rods in position to protect the attachment lugs.

The view of FIG. 8 illustrates the arrangement for stabilizing the kit frame 25 against torque loads especially when the auger 18 strikes an obstruction. The closed side of the frame 25 has the opening 35 to receive the projection 32 on the driving head 19 for the auger 18. A plate 75 is bolted onto the closed side by elements 76 so it extends to each side of the opening 35. The plate is formed with ears 77 which project outwardly to an extent sufficient for each to abut on the driving head 19. It will be recalled that the mounting tabs 39 and 40 project toward the driving head 19 and are secured to such head by cap screws. The tabs 40 are formed with apertures 80 to receive the tension rods 78 which extend to the ears 77 where nuts 79 are applied to secure the rods in position with the heads (see FIG. 4 also) seated in the tabs 40.

With the kit 24 properly mounted on the driving head 19, the control lever 60 can be connected up to its lanyard cord 81 which has one end 82 fastened to the outer end of the lever 60 after passing around a suitable roller 83. The opposite end 84 is connected to a lock element 85 which is provided with a pin 86 placed to drop in an aperture 87 in the frame 25 when the lever 60 is drawn up to the position (FIG. 5) in which the kit is in the forward direction of auger rotation. When reverse auger rotation is desired, the lower run of the lanyard is pulled to raise the lock element 85 thereby lifting the pin 86 free of aperture 87 and against the tension in spring 88. Still maintaining a pull on the lower run of the lanyard, the upper run can be pulled to pivot the control lever 60 in a direction to shift the shaft 58 to begin changing the gear positions in the frame 25 for effecting reverse auger rotation. A lanyard guide 89 is carried by the frame 25 to retain the lanyard cord 81 in alignment with the roller 83 and lock element 85.

The foregoing disclosure as set forth is a presently preferred embodiment of a reversible drive kit applied between a power input torque shaft and the driving head of an auger having a pinion that can be exposed and used to connect up with a suitable receiver in the kit. The arrangement of components in the kit frame includes a pair of ring gears carried by the receiver, a train of gears and a shift lever connected to one of the pair of ring gears and connecting it to the train of gears for change of direction of auger rotation, and a directional control lever.

While the present invention refers to a reversible auger drive kit suitable for converting the older reversing provisions, it is to be understood that the kit may be incorporated as original equipment in auger-type hold digging apparatus.

What is claimed is:

1. In an auger drive arrangement in which there is an auger driving head with a power input receiving pinion shaft projecting from the driving head, a bidirectional drive kit for the driving head comprising:

(a) a reversible power transmission assembly connected to the input pinion shaft, and in which assembly there is:

1. A power input receiver formed with angularly directed splines thereon and being connected to the pinion shaft and an arrangement of a pair of gears carried by said receiver and having cooperating half-step positive interlocking ramps thereon adapted in a first position to hold said gears engaged with each other and through said receiver splines with the input pinion shaft for transmitting power through the input pinion shaft to drive the auger in a first direction of rotation, one gear of said pair of gears being fixed to said receiver and the other gear of said pair of gears being slidably connected to said receiver through said splines;
2. lever means in the assembly for selectively separating said pair of gears by sliding said other gear on said receiver splines thereby interrupting the first direction of auger rotation and for moving said pair of gears into the engaged first position;
3. a train of gears adjacent said pair of gears and operably arranged to have a first position out of engagement with said pair of gears and a second position engaged with said separated pair of gears for transmitting power through the input pinion shaft to drive the auger in a second direction of rotation reverse to said first direction; and (b) control means operably connected to said train of gears for arranging said train of gears selectively in said first and second positions, said control means having an operating connection with said lever means for effecting sliding movement of said other gear.

2. A reversible drive kit for operative disposition between a remote power source and a drive head for a hole digging auger, said kit comprising:

(a) a frame supported by the drive head and having a rotatable receiver for establishing a drive connection with the remote power source;

(b) a first gear rotatably carried by said receiver for independent relative rotation;

(c) a second gear carried by said receiver and rotatable with and slidable on said receiver into and out of engagement with said first gear;

(d) adapted means connected to said first gear in position to connect up with the drive head;

(e) shift lever means operative for positioning said second gear in a first position in engagement with said first gear to establish a direct drive transfer from the remote power source to the drive head through said rotatable receiver, said shift lever positioning said second gear in a second position out of engagement with said first gear;

(f) a train of gears operatively movable in said frame between a first position free of engagement with said first and second gears and a second position in engagement with said first and second gears; and (g) manually operable control means operatively connected to said train of gears for moving said train of gears and said shift lever means simultaneously and selectively between said respective first positions and said respective second positions.

3. A reversible drive kit operably connected between a power input torque shaft and the pinion shaft of an auger driving head, said kit comprising:

(a) a frame connected to the driving head of the auger and having a rotatable receiver in position to connect to a power input torque shaft, said receiver being cylindrical and formed on an exterior surface with a plurality of splines having an angular position relative to the axis of said receiver;

(b) a first gear positioned on said receiver for independent rotation on said rotatable receiver;

(c) adapter means in said frame providing a connection between said first gear and the driving head pinion shaft;

(d) a second gear connected to rotate with said receiver and operable to move relative to said receiver into and out of a position operably engaged to said first gear for rotation selectively with said first gear and receiver and only with said receiver;

(e) gear train means operable in said frame adjacent said first and second gears and said receiver, said gear train having a great gear and a lesser gear, and an idler gear so when forward torque is required at said receiver said second gear is moved into mesh with said first gear to establish forward drive of said driving head and when reverse torque is required at said receiver said second gear is disengaged from said first gear and said first and second gears are interconnected serially through said great gear, said lesser gear and idler gear, and said idler gear respectively;

(f) sift lever means in said gear train having a connection with said second gear to move said second gear into engagement with said first gear and to move said second gear to a position to rotate only with said receiver; and (g) control means having an operating connection with said gear train to position said shift lever and said train in positions selectively in which said first and second gears are operably engaged to directly connect the driving head pinion shaft with said receiver for rotation in one direction of the auger, and in which said second gear rotates only with said receiver and said gear train operably connects the said first gear with said second gear for rotation of the driving head shaft in an opposite direction to said one direction.

4. A reversible drive kit as set forth in claim 3 wherein said first and second gears have cooperating ramps for maintaining an operative engagement of said first and second gears by preventing said separation of first and second gears in forward drive of said driving head.

5. A reversible drive kit as set forth in claim 4 wherein said cooperating ramps are so shaped as to effect a meshing engagement between said first and second gears prior to having the power input torque shaft advance the rotated position of said second gear ahead of said ramps' meshing engagement between said first and second gears.

6. A reversible drive kit as set forth in claim 3 wherein said second gear is formed with a circumferential groove, said shift lever means has a pair of fingers positioned in said circumferential groove so as to allow for rotation of said second gear, and said shift lever includes means to adjust the position of said pair of fingers in said circumferential groove to reduce wear.

* * * * *